United States Patent [19]

Laughinghouse

[11] 3,968,372

[45] July 6, 1976

[54] TUBE PROTECTION CIRCUIT FOR X-RAY GENERATORS

[75] Inventor: Charles Leo Laughinghouse, Linthicum, Md.

[73] Assignee: CGR Medical Corporation, Baltimore, Md.

[22] Filed: Nov. 24, 1975

[21] Appl. No.: 634,316

[52] U.S. Cl. ..... 250/402; 250/409

[51] Int. Cl.[2] ..... H05G 1/30

[58] Field of Search ..... 250/401, 402, 408, 409, 250/413, 414

[56] References Cited

UNITED STATES PATENTS 3,838,285 9/1974 Siedband ..... 250/413

*Primary Examiner*—Craig E. Church

*Attorney, Agent, or Firm*—Brady, O'Boyle & Gates

[57] ABSTRACT

An X-ray tube protective circuit wherein the selected exposure time and X-ray tube power are compared prior to operation to determine whether or not a condition exists which would exceed the anode rating of the tube and thereafter prevents operation while permitting an X-ray exposure for a safe condition. The subject invention is directed to a means for reducing the number of switch decks normally required in connection with a plurality of resistive voltage divider networks utilized to simulate the tube rating charts for the X-ray tube(s) utilized and comprises a plurality of resistive networks simulating rating chart curves mounted on a plug-in printed circuit board and coupled to a common time select switch deck by means of an isolating diode network. A current source is connected to a circuit node of the selected resistor network through the time selector switch and diode network which in combination with a reference voltage applied to one end of the selected resistor network, develops a signal at the opposite end thereof which corresponds to the allowable kV × mA for the time selected which is applied to one input of a comparator whose other input is coupled to a signal corresponding to the desired kV × mA and whose output is fed to the control circuitry which is adapted to enable or inhibit X-ray tube operation.

15 Claims, 4 Drawing Figures

TUBE PROTECTION CIRCUIT FOR X-RAY GENERATORS

BACKGROUND OF THE INVENTION

1. Field of the Invention

This invention relates to X-ray apparatus and more particularly to an electrical system for automatically preventing X-ray exposures under overload conditions.

2. Description of the Prior Art

Modern high power X-ray tubes normally include a tungsten filament encased in a cathode cup which is mounted a short distance away from a rotating tungsten anode. The anode, in turn, is connected to a motor armature and bearing assembly with the entire structure mounted within a glass envelope of the X-ray tube. The tube is placed such that the motor armature and that portion of the glass envelope surrounding it are within the motor stator winding. When the winding is energized, the anode rotates so that during the X-ray exposure, new areas of the anode are brought within the electron beam cross section. The thermal capacity of the tube, i.e., the maximum X-ray exposure possible without damage to the anode, is determined by the energy lever per exposure which is a function of the peak power kW expressed in terms of voltage (kV) and current (mA) and the exposure time in seconds (sec.), the area on the anode subtended by the electron beam as well as the shape and finally the speed of rotation of the anode.

In an effort to obtain the maximum output per exposure of a particular X-ray tube, the manufacturer attempts to rate the respective tube at the maximum possible value per exposure such that the anode is brought almost to the point of melting during each X-ray exposure. In order to do this, the manufacturer publishes curves called "rating charts" which describe the maximum exposure for a particular X-ray tube under the various conditions of operation.

Prior art protective circuits provide a control circuit which is responsive to analog voltages that are functions of the desired power level and the exposure time duration, respectively, and being then operative to compare the manual setting made by the operator with predetermined known maximum safe values allowed by the tube rating chart curve for the particular X-ray tube employed. These analog voltages are generated by means of suitable power supply voltages feeding two voltage divider networks, one of which corresponds to X-ray tube power, while the other corresponds to X-ray exposure time. If the X-ray generator operates for example with three X-ray tubes, and if each X-ray tube has two different focal spot sizes and further if the X-ray tube anodes are permitted to rotate at two different speeds (standard speed and ultra speed) separate voltage divider switch decks for exposure time (numbering 12 in total) are normally required and which are ganged on the X-ray exposure time switch shaft in order to simulate each rating chart curve for the particular mode of operation desired.

One approach to the problem is suggested in the teachings of U.S. Pat. No. 3,838,285, entitled "X-ray Tube Anode Protective Circuit," M.P. Sieband, et al. and assigned to the assignee of the present invention. The protective circuit there utilizes a single empirically derived anode rating chart curve which is representative of a generalized or standard X-ray tube rating chart curve. This empirical curve is generated by a series connected string of resistors connected to the exposure time select switch. This curve is then tilted and/or offset for selected operating modes in order to substantially conform to the actual rating curve for the respective various focal spot sizes and anode speeds of the particular X-ray tube in use. While this is acceptable for certain applications, it nevertheless becomes undesirable where a more exact conformance to the actual rating chart curve is desired.

SUMMARY

Accordingly, it is an object of the present invention to provide a means for not only protecting an X-ray tube against every possible exposure overload but also to reduce switch deck requirements in such a fashion that the replacement of the multiple voltage divider networks simulating the rating chart curves are simplified during maintenance procedures wherein for example one X-ray tube is changed for another type of tube. Briefly, the invention comprises a plurality of resistor networks, each simulating a specific rating chart curve mounted on a plug-in type printed circuit board base member and having circuit nodes commonly coupled to selected switch contacts of a common time select switch by means of a blocking diode network which is adapted to act as isolation switch means and being operable to isolate a selected operative resistor network from the other resistor networks which are inoperative. A constant current source is coupled through the time select switch and the diode network to a selected circuit node corresponding to a desired exposure time of the selected resistor network whereupon a voltage is developed in combination with a reference voltage source applied to one end of the selected resistor network provides a voltage signal at its other end corresponding to the allowable kV × mA for the time selected and which is applied to one input of a comparator circuit whose other input is coupled to a signal proportional to the desired kV × mA and whose output is adapted to be coupled to control circuitry for either enabling or inhibiting an X-ray exposure.

DESCRIPTION OF THE PREFERRED EMBODIMENT

Figure 1:
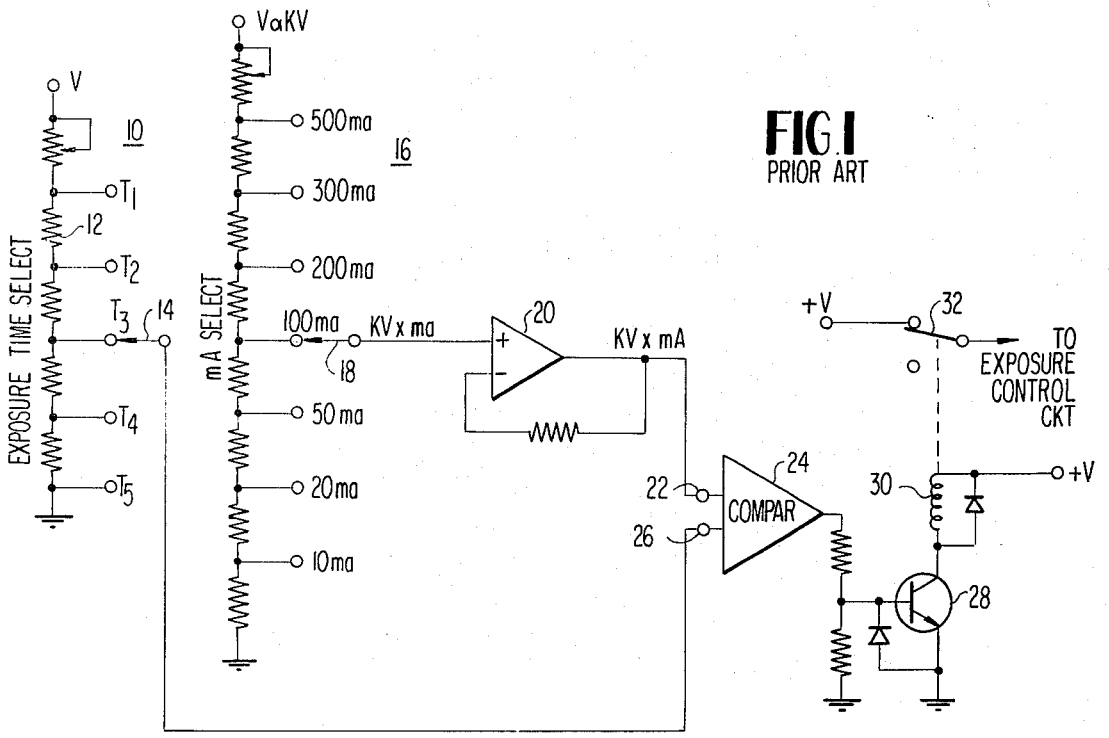
FIG. 1 PRIOR ART
FIG. 1 is an electrical schematic diagram generally illustrative of a prior art X-ray tube anode protective circuit.

Referring now to the drawings wherein like reference characters refer to like parts throughout, attention is directed to FIG. 1 which is illustrative of prior art practice and wherein reference numeral 10 designates but one of a plurality of individual "switch decks" which are adapted to provide an electrical analog of the respective rating chart curves for each operational mode desired for a system including one or more X-ray tubes, not shown. Each switch deck 10 consists of a resistive voltage divider network 12 coupled across a reference voltage source $V_{ref}$ and has a plurality of voltage taps connected to fixed switch contacts of the respective rotary switch 14. The voltage at each tap is representative of the corresponding allowable peak power of the appropriate rating chart curve at selectable exposure times $T_1$, $T_2$ . . . $T_n$. Where, for example, three X-ray tubes are utilized in an X-ray system and being operable to provide two focal spot sizes and operate at two rotating speeds, a standard speed and an ultra-speed, twelve switch decks would be required each having a respective rotary switch 14 ganged together on the same shaft of an operator manipulated X-ray exposure time selector switch and as such must be changed when changing from one tube type to another. Considerable space is not only required for the multiple switch decks, but includes a tedious and undesirably long procedure when changing from one tube type to another.

Prior art anode protective circuits also include another resistive voltage divider network 16, coupled across a voltage proportional to the X-ray tube high voltage potential (kV) which is held constant. A plurality of voltage taps corresponding to selectable values of anode current, (mA) terminate in the fixed contacts of a rotary selection switch 18, which is coupled to an operational amplifier 20, which provides an appropriate scale factor, such that its output signal comprises a voltage proportional to the desired kV × mA which is the instantaneous power (kW) setting desired by the operator for the forthcoming X-ray exposure. This signal is applied to one terminal 22 of a comparator circuit 24 whose other input 26 is coupled to a signal from the exposure time select switch corresponding to the maximum allowable kV × mA rating imposed by the tube manufacturer for a selected exposure time as selected in accordance with the setting of the rotary switch 14 of the appropriate switch deck 10 utilized for the particular mode of operation. If the signal applied to terminal 22 is less than the signal applied to terminal 26 indicating that the allowable instantaneous kW for the time selected is not exceeded, the output of comparator 24 is insufficient to render transistor switch 28 conductive. However, if the allowed instantaneous power is exceeded, transistor 28 will be rendered conductive, causing suitable circuitry such as a relay coil 30 to be energized, which is operable to actuate a set of relay contacts 32, causing an exposure control circuit, not shown, to become inoperative.

Thus when an operator selects the tube and mode of operation desired, the appropriate switch deck including the required resistive voltage divider network provides a rating chart analog when it is energized, i.e., coupled across a voltage source which provides a predetermined fixed reference voltage. When the exposure time is set, a selected voltage is coupled from that deck and compared to the voltage associated with the selected electron beam current mA of the X-ray tube and an X-ray exposure is either permitted or prevented as a function of whether the selected power exceeds the anode rating of the tube or whether it is within bounds. The inclusion of such circuitry is standard practice and takes many forms and variations. As noted above, the switching decks including the voltage dividers must be selected for each X-ray tube focal spot and operating characteristics. In the field, if it is necessary to change from one type to another, the appropriate switching decks must also be changed.

Accordingly, it is an object of the present invention to reduce switch deck requirements while at the same time utilizing a plurality of individual voltage divider network analog circuits for the respective rating chart curves utilized, but to be able to readily remove and replace the individual voltage divider networks easily and quickly.

Figure 2:
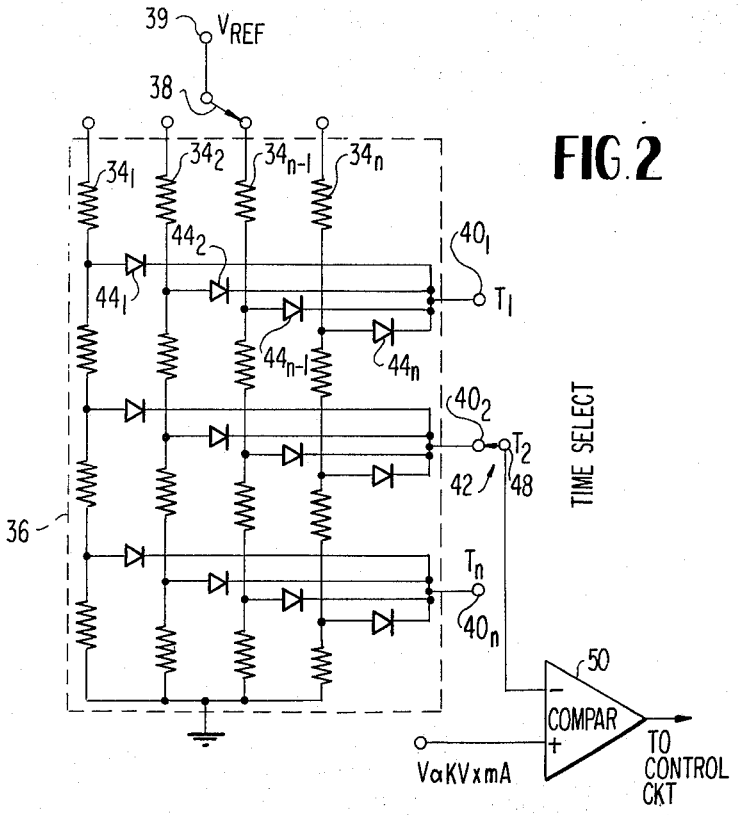
FIG. 2 is an electrical schematic diagram illustrative of one solution to the problem of multiple switch decks.

One solution to the problem is disclosed in FIG. 2, wherein the plurality of voltage divider networks $\mathbf{34_1}$, $\mathbf{34_2}$, . . . $\mathbf{34_{n-1}}$, and $\mathbf{34_n}$ are mounted on a base member 36 which is adapted to include plug-in type connectors, not shown, and whereupon each of the voltage dividers are fabricated on individual plug-in circuit assemblies. The base member 36, for example, may consist of a printed circuit board and the plurality of resistive voltage dividers are located in individual plug-in modules of any desired type. An operational mode select switch 38 is adapted to couple a reference voltage $V_{ref}$ from a source, not shown, applied to terminal 39 across a selected one of the voltage divider networks $\mathbf{34_1}$, $\mathbf{34_2}$ . . . $\mathbf{34_n}$. Each of the voltage taps provided thereby for a specific exposure time $T_1$, $T_2$ . . . $T_n$ are commonly coupled to respective fixed switch contacts $\mathbf{40_1}$, $\mathbf{40_2}$, and $\mathbf{40_n}$ of a single rotary time select switch 42. The voltage tap for the period $T_1$, for example, for each of the voltage divider networks $\mathbf{34_1}$ . . . $\mathbf{34_n}$ are coupled to the fixed switch contact $\mathbf{40_1}$ by means of a respective semiconductor diode $\mathbf{44_1}$, $\mathbf{44_2}$, $\mathbf{44_{n-1}}$ and $\mathbf{44_n}$, and which are identically poled to conduct current between the respective voltage tap and the switch contact 40, while blocking current flow to other like time voltage taps. In the configuration shown in FIG. 2, the refernece voltage $V_{ref}$ would be a positive polarity potential, inasmuch as the diodes have their respective anode electrodes coupled to the voltage tap whereas the cathode is connected to switch terminal $\mathbf{40_1}$. In a like manner, the remainder of the voltage taps for the times $T_2$ . . . $T_n$ have respective diodes coupled to the switch terminals $\mathbf{40_2}$ . . . $\mathbf{40_n}$. With the mode select switch 38, for example, coupled to voltage divider $\mathbf{34_2}$, the diode $\mathbf{44_2}$ is adapted to couple the voltage present at voltage tap $\mathbf{46_2}$ to the switch terminal $\mathbf{40_1}$ by means of the diode $\mathbf{44_2}$. It is to be noted, however, that the other diodes $\mathbf{44_1}$, $\mathbf{44_{n-1}}$ and $\mathbf{44_n}$ become back biased and effectively block the voltage from appearing at voltage taps $\mathbf{46_1}$, $\mathbf{46_{n-1}}$ and $\mathbf{46_n}$ as well as all other voltage taps. Accordingly, the diode network provides switching diodes which effectively isolate the selected voltage divider network, for example divider $\mathbf{34_2}$ from the other voltage dividers. Thus one rotary switch 42 is common to all of the voltage divider networks, whereupon a single movable contact 48 thereof is adapted to couple a signal corresponding to all maximum allowable kV × mA values required for the many selected exposure times $T_1$, $T_2$ . . . $T_n$. This signal is coupled to one of the inverting input (−) of a comparator circuit 50, whose other or non-inverting input (+) has a signal applied thereto corresponding to a voltage proportional to the desired kV × mA. The comparator again operates as noted with respect to the circuit shown in FIG. 1, to provide an output for controlling an exposure control circuit for either permitting or inhibiting operation.

The circuit shown in FIG. 2 is well suited for operation where the magnitude of the reference voltage $V_{ref}$ applied to the mode select switch 38 is of a relatively large magnitude, e.g., 100–150 volts, whereupon the voltage drop across the individual diodes $\mathbf{44_1}$, $\mathbf{44_2}$ . . . $\mathbf{44_n}$ is negligible when conducting. However, where the magnitude of the reference voltage $V_{ref}$ is of a magnitude applicablle for transistor supply potentials and being in the order of 15 volts, for example, the diode voltage drop cannot be considered negligible and since it varies with temperature, age and other operating parameters, the analog voltages at the various voltage taps associated with the voltage dividers $34_1$, etc., will not always accurately represent the desired rating chart curves within the necessary tolerances either desired and/or required.

Figure 3:
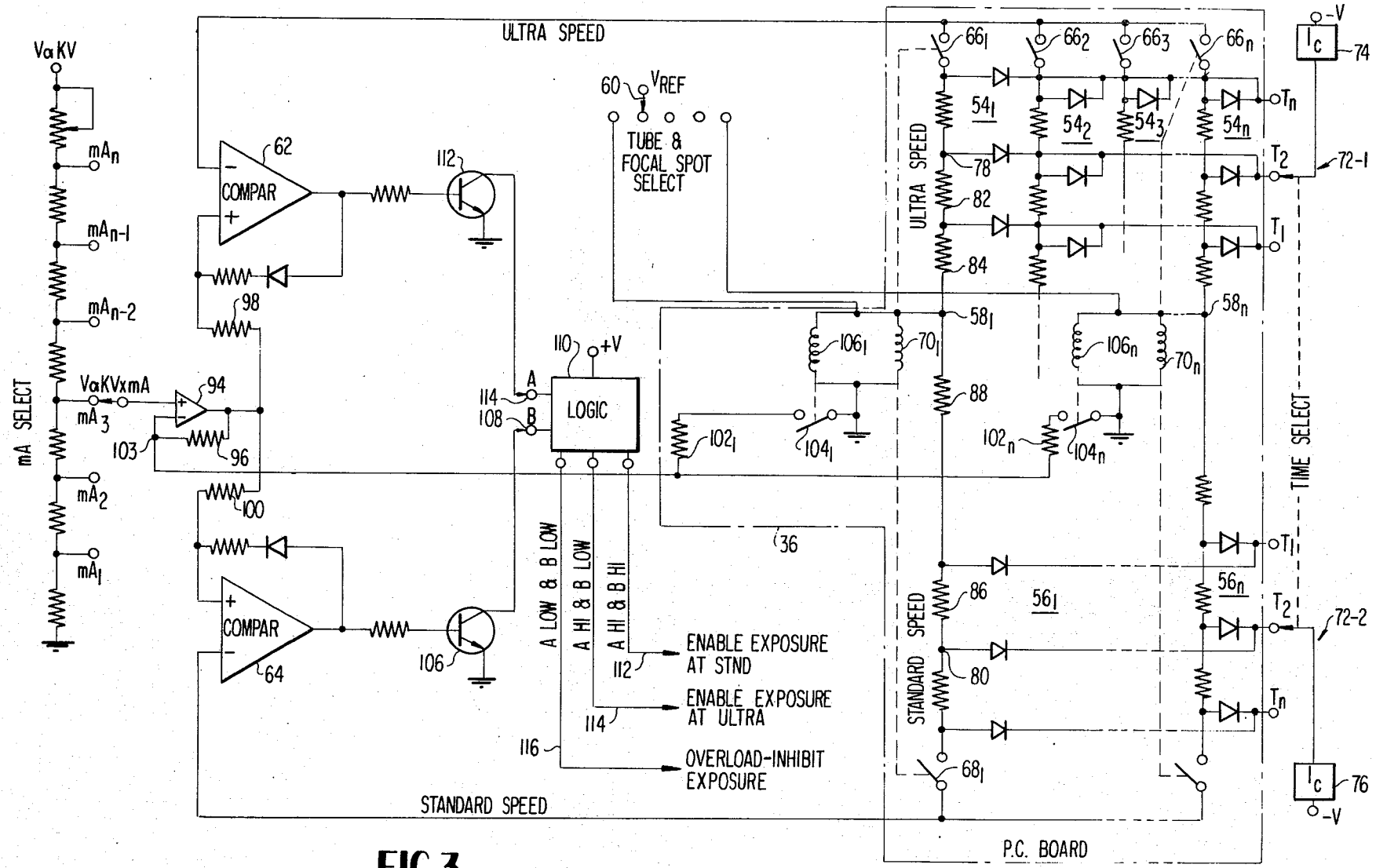
FIG. 3 is a schematic diagram illustrative of the preferred embodiment of the subject invention.

Accordingly, reference is now made to FIG. 3, which discloses the preferred embodiment of the subject invention wherein reference numeral 52 represents a printed circuit board including plug-in connectors, not shown, which are adapted to receive plug-in modules for a plurality of rating chart curve resistive networks $54_1$, $54_2$, $54_3$ . . . $54_n$ which are utilized for ultra speed applications and networks $56_1$ . . . $56_n$ which are utilized for standard speed applications. The resistor networks $54_1$ . . . $54_n$ and $56_1$ . . . $56_n$ are adapted to provide electrical analog representations at the respective circuit nodes, of selected rating chart curves for exposure times $T_1$, $T_2$ . . . $T_n$ for a plurality of tubes and focal spot sizes therefor. Pairs of resistor networks, for example, networks $54_1$ and $56_1$ have a common circuit junction $58_1$, which is connected to a common fixed contact of an operational mode selector switch 60 whose movable contact is connected to a fixed voltage source $V_{ref}$ shown equal to +15 volts. The last pair of resistor networks $54_n$ and $56_n$ also share a common circuit junction $58_n$ which is coupled to a respective fixed contact of a selector switch 60. The opposite ends of the resistor networks $54_1$ and $56_1$, for example, rather than being coupled to ground and forming a voltage divider as shown in FIG. 2, are now coupled to the inverting input (−) of a respective comparator circuit 62 and 64 by means of relay contacts $66_1$ and $68_1$ which are closed by means of a relay solenoid coil $70_1$ upon the application of the reference potential (+15V) applied to circuit junction $58_1$ by means of the selector switch 60. The same arrangement exists for the other resistor networks $54_2$ . . . $54_n$ and $56_2$ . . . $56_n$.

As in the case of the configuration shown in FIG. 2, each node voltage for a like exposure time $T_1$, $T_2$ . . . $T_n$ are coupled to a common time selector switch contact; however in the instant embodiment, two ganged switch sections 72-1 and 72-2 are utilized, one for the ultra speed group of resistor networks $54_1$ . . . $54_n$ and the other for the standard speed group $56_1$ . . . $56_n$.

In order to overcome a diode voltage drop problem noted above with respect to relatively low value reference voltage (+15V) being applied to the top or upper end of the voltage dividers, a first constant current $I_c$ source 74 having a negative (−V) supply potential applied thereto is coupled to the movable cntact of switch section 72-1 while a second constant current $I_c$ source 76 also having a negative supply potential applied thereto is coupled to the movable contact of the second switch section 72-2. Assuming that both switch sections 72-1 and 72-2 are in the $T_2$ position and that mode selector switch 60 couples the +15V voltage source to circuit junction $58_1$ which is common to resistor networks $54_1$ and $56_1$, a voltage appears at circuit nodes 78 and 80 which is equal to the magnitude of the reference voltage $V_{ref}$, i.e. +15V applied to switch 60 minus an IR voltage drop determined by the mangitude of the constant current source ($I_c$) times the sum of the resistances connecting circuit junction $58_1$ to the respective circuit nodes 78 and 80. Expressed in equation form:

$$V_{78} = V_{ref} - I_{c_1}(R_{82} + R_{84})$$

and $$V_{80} = V_{ref} - I_{c_2}(R_{86} + R_{88})$$

Thus, the desired analog voltage is established by the difference between the reference voltage $V_{ref}$ and the $I_R$ voltage drop generated by the respective constant current source and as noted above, corresponds to the desired rating chart curve value indicative of allowable maximum kV × mA for the selected exposure time. The signals appearing at nodes 78 and 80 are applied to one input (−) of respective comparators 62 and 64 by means of relay contacts $66_1$ and $68_1$. The other or non-inverting input (+) to the comparators is coupled to a signal proportional to the desired instantaneous power kW and is developed by means of a resistive voltage divider network 90 connected across a voltage proportional to the high voltage (kV) and having a plurality of voltage taps corresponding to selected current values $mA_1$ . . . $mA_n$ which are connected to the fixed contacts of a rotary type mA select switch 92 having its movable contact coupled to an operational amplifier 94. The output of the amplifier 94 is coupled to the (+) inputs of comparators 62 and 64 by means of the respective coupling resistors 98 and 100. A resistor 96 is shown coupled from the output of amplifier 94 back to its (−) input and acts in comination with a selected resistor $102_1$ . . . $102_n$ connected to junction 103 to form a voltage amplifier for the signal input to the comparators 62 and 64. The resistors $102_1$ . . . $102_n$ are connected to ground through a set of relay contacts $104_1$ . . . $104_n$ closed by means of a respective relay coil $106_1$ . . . $106_n$ which is energized when the reference voltage is applied to circuit junction $58_1$ . . . $58_n$ through the selector switch 60. Thus the voltage amplifier action provided by the resistor 96 and a selected resistor $102_1$ . . . $102_n$ provides a desired scale factor to both comparator (+) inputs.

If, for example, the selected kV × mA exceeds the allowable rating at standard speed, the output of comparator 64 causes transistor 106 to become conductive, causing the voltage at terminal 108 to go to a low value (ground potential). Accordingly, a digital type signal B is provided which is applied to a logic circuit 110. In a like manner, if the allowable tube rating is exceeded at ultra speed, the comparator circuit 62 causes transistor 112 to become conductive, whereupon terminal 114 goes to ground potential providing a digital signal A, which is also coupled to the logic circuit 110. If both digital signals A and B are both "high," the logic circuit 110 provides an enabling signal on signal lead 112 for an exposure control circuit, not shown. If the signal A is "high," indicative that exposure is permissible at ultra speed, whereas signal B is "low," indicative that the tube rating would be exceeded at a standard speed, the logic circuit 110 provides an enabling signal on signal lead 114 for exposure at ultra speed only, which signal is also coupled to the exposure control circuit. If both digital signals A and B are "low," indicative of the fact that the tube rating would be exceeded at either speed, the logic circuit 110 provides an output on line 116, which is coupled to the exposure control circuit for inhibiting any exposure.

Figure 4:
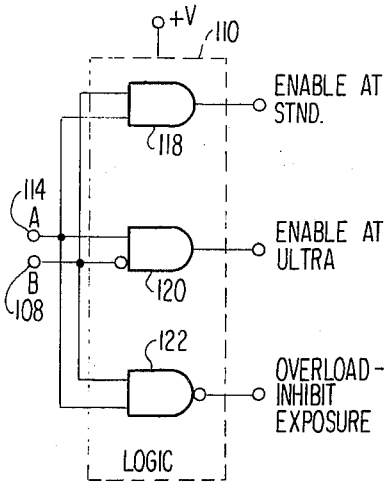
FIG. 4 is an electrical schematic diagram illustrative of a typical logic circuit utilized in connection with the subject invention.

One example of a digital logic circuit adapted to provide the desired enabling and inhibit exposure control functions is shown in FIG. 4 and includes two AND digital logic circuits 118 and 120 and one NAND circuit 122. Thus if the inputs A and B are "high," the output of AND circuit 118 will be "high." If either signal A or B is "low," the output of AND circuit 118 will remain in a "low" state. As to AND circuit 120, however, the input connected to the B signal comprises an inverting input such that the output is "high" only in the event that signal A is "high" and signal B is "low." The NAND circuit 122 is operative such that when both digital signals A and B are "low," the output is "high" and vice versa.

In summation, therefore, the subject invention is directed to an improved protection circuit for the anode of an X-ray tube employing readily replaceable plug-in type tube rating chart resistor networks which are coupled to a common switch deck through isolating switching diodes coupled from the switch contacts to the voltage taps, thereby providing analog voltages proportional to the maximum allowable kV × mA rating imposed by the tube manufacturer and from which comparison is made with an analog voltage corresponding to selected $KV_p$ and anode current so as to prevent an exposure in the event that the tube rating is exceeded.

Having disclosed what is at present considered to be the preferred embodiment of the subject invention,

I claim:

1. In an X-ray tube anode protection circuit having circuit means being operated by the output of a comparator circuit which compares selected values of electrical analog voltages representative of X-ray tube rating chart curves against selected values of analog voltages corresponding to desired exposure time and anode current for preventing energization of the X-ray tube in the event the desired operating parameters exceed the rating of the X-ray tube, the improvement comprising:

a source voltage of a predetermined reference value;

a plurality of circuit means selectively coupled to said source voltage, each of said circuit means having a current-voltage characteristic adapted to simulate a predetermined rating chart curve which is a function of a plurality of exposure times and providing a plurality of signals at selected circuit points corresponding to allowable peak power for said exposure times;

a time select switch for said plurality of circuit means and having a movable contact and a plurality of fixed contacts;

respective diode means coupling like exposure time circuit points of said plurality of circuit means to a common circuit junction coupled to respective fixed contacts of said plurality of fixed contacts, said diode means being identically poled to conduct current between the respective circuit points and said common circuit junction while blocking current flow to other like time circuit points and thereby providing isolation between said circuit means;

circuit means coupling a selected circuit point to said comparator circuit for applying an analog signal corresponding to allowable peak power; and circuit means providing and coupling a signal proportional to the product of the desired anode voltage and beam current to said comparator circuit.

2. An X-ray tube anode protection circuit having circuit means being operated by the output of a comparator circuit which compares selected values of electrical analog voltages representative of X-ray tube rating chart curves against selected values of analog voltages corresponding to desired kV and anode current for preventing energization of the X-ray tube in the event the desired operating parameters exceed the rating of the X-ray tube, comprising in combination:

a source voltage of a predetermined value;

a plurality of resistor networks having one end selectively coupled to said source voltage and the other end to said comparator circuit, each of said networks having a current-voltage characteristic adapted to simulate a predetermined rating chart curve which is a function of a plurality of exposure times and providing a plurality of circuit nodes exhibiting a respective signal voltage corresponding to allowable peak power for said exposure times;

a common time select switch for said plurality of resistor networks and having a movable contact and a plurality of fixed contacts;

respective diode means coupling like exposure time circuit nodes of said plurality of resistor networks to a like fixed contact of said plurality of fixed contacts, said diode means being identically poled to conduct current between the respective circuit node and said fixed contact while blocking current flow to other like time circuit nodes;

a current source coupled to said movable contact and providing current flow through a selected portion of the selected resistor network generating a voltage drop therein which in combination with said source voltage provides a predetermined analog voltage at the selected circuit node corresponding to the maximum allowable instantaneous power for the desired exposure time; and circuit means for providing an analog voltage proportional to the product of the desired anode voltage and beam current coupled to said comparator circuit.

3. The protection circuit as defined by claim 2, and additionally including first switch means coupling said source voltage to a selected one of said plurality of resistor networks; and second switch means coupling the other end of said selected voltage divider network to a first input of said comparator circuit.

4. The protection circuit as defined by claim 3 wherein said second switch means comprises a set of relay contacts which are rendered closed upon the application of said source voltage to said selected resistor network.

5. The protection circuit as defined by claim 4 wherein said source voltage comprises a substantially constant voltage and said current source provides a substantially constant unidirectional current.

6. The protection circuit as defined by claim 5 wherein said resistor networks are comprised of a plurality of series connected resistors.

7. The protection circuit as defined by claim 2 wherein said diode means comprise semiconductor diodes.

8. The protection circuit as defined by claim 2 wherein said diode means comprises at least one semiconductor diode respectively coupled to each circuit node.

9. The protection circuit as defined by claim 2 wherein said circuit means for providing the voltage proportional to the product of X-ray anode voltage and beam current comprises a voltage divider network coupled across a voltage proportional to the X-ray anode supply voltage and includes a plurality of voltage taps providing respective signal voltages proportional to the product of anode voltage and beam current, mA select switch means having a movable switch contact and a plurality of fixed contacts selectively connected to said plurality of voltage taps of said voltage divider network; and circuit means coupling the movable contact of said second switch means to a second input of said comparator circuit.

10. The protection circuit as defined by claim 9 wherein said coupling circuit means includes amplifier means for providing a predetermined scale factor for the input signal to said comparator circuit.

11. The protection circuit as defined by claim 10 and additionally including circuit means coupled to the input of said amplifier means for selectively changing the scale factor of said input signal to said comparator circuit.

12. The protection circuit as defined by claim 11 wherein said circuit means for changing the scale factor comprises a voltage divider including a first resistor having one side connected to the input of said amplifier and the other side connected to ground potential upon the application of said source voltage to said one end of the selected voltage divider network and a second resistor connected from the output of said amplifier back to its input.

13. The protection circuit as defined by claim 2 wherein said first switch means is adapted to coupled said source voltage simultaneously to a selected another of said plurality of resistor networks, providing a pair of energized voltage dividers thereby, one for standard rotary speed operation and the other for ultra rotary speed operation, and additionally including another comparator circuit wherein said second switch means couples the other end of one of said pair of resistor networks for standard speed operation to the input of one of said comparator circuits and the other end of said other resistor network for ultra speed operation to the input of the other of said comparator circuits, and logic circuit means coupled to the output of both said comparator circuits to provide predetermined enabling and inhibiting signals for energization control of the X-ray tube.

14. The protection circuit as defined by claim 2 wherein said plurality of resistor networks are located on respective plug-in assemblies mounted on a common base member.

15. The protection circuit as defined by claim 14 wherein said base member comprises a printed circuit board.

* * * * *